US005901425A

United States Patent [19]

Bibl et al.

[11] Patent Number: 5,901,425

[45] Date of Patent: May 11, 1999

[54] INKJET PRINT HEAD APPARATUS

[75] Inventors: Andreas Bibl, Los Altos; Mats G. Ottosson, Sunnyvale; Deane A. Gardner, Cupertino, all of Calif.

[73] Assignee: Topaz Technologies Inc., Sunnyvale, Calif.

[21] Appl. No.: 08/891,131

[22] Filed: Jul. 10, 1997

Related U.S. Application Data

[62] Division of application No. 08/703,924, Aug. 27, 1996.

[51] Int. Cl.[6] ..... H04R 17/00

[52] U.S. Cl. ..... 29/25.35; 347/69

[58] Field of Search ..... 29/25.35; 347/68, 347/69, 70, 71, 72

[56] References Cited

U.S. PATENT DOCUMENTS

| | | | |
|---|---|---|---|
| Re. 31,357 | 8/1983 | Cone | 346/75 |
| Re. 32,572 | 1/1988 | Hawkins et al. | 156/626 |
| 3,659,951 | 5/1972 | Germann | 401/190 |
| 3,662,399 | 5/1972 | Yanou et al. | 346/140 |
| 3,667,678 | 6/1972 | Haskell | 239/102 |
| 3,776,461 | 12/1973 | Kashio | 239/125 |
| 3,921,916 | 11/1975 | Bassous | 239/601 |
| 3,927,410 | 12/1975 | Pimbley | 346/140 |
| 3,953,862 | 4/1976 | Amberntsson et al. | 346/140 |
| 3,955,953 | 5/1976 | Hauser | 65/18 |
| 3,958,255 | 5/1976 | Chiou et al. | 346/140 |
| 4,002,230 | 1/1977 | Schweppe et al. | 197/1 |
| 4,005,440 | 1/1977 | Amberntsson et al. | 346/140 |
| 4,007,464 | 2/1977 | Bassous et al. | 346/75 |
| 4,008,111 | 2/1977 | Rutz | 156/656 |
| 4,015,271 | 3/1977 | Sultan | 346/140 |
| 4,025,928 | 5/1977 | Hou et al. | 346/140 |
| 4,045,801 | 8/1977 | Iwasaki | 346/140 |
| 4,047,186 | 9/1977 | Kendall et al. | 346/140 |
| 4,059,480 | 11/1977 | Ruh et al. | 156/644 |
| 4,066,491 | 1/1978 | Ruh et al. | 156/644 |
| 4,095,237 | 6/1978 | Ambernsson et al. | 346/140 |
| 4,106,975 | 8/1978 | Berkenblit et al. | 156/628 |
| 4,106,976 | 8/1978 | Chiou et al. | 156/644 |
| 4,112,170 | 9/1978 | Rauscher | 428/212 |
| 4,112,436 | 9/1978 | Come | 346/140 |
| 4,121,227 | 10/1978 | Fischbeck et al. | 346/140 |
| 4,122,460 | 10/1978 | Humenik et al. | 346/140 |
| 4,123,571 | 10/1978 | Balog et al. | 427/249 |
| 4,146,899 | 3/1979 | Paranjpe et al. | 346/75 |
| 4,153,901 | 5/1979 | White et al. | 346/75 |

(List continued on next page.)

FOREIGN PATENT DOCUMENTS

| | | | |
|---|---|---|---|
| 0095911 A2 | 12/1983 | European Pat. Off. | B41J 3/04 |
| P 0116971 A1 | 8/1984 | European Pat. Off. | B41J 3/04 |
| 0268204 A1 | 5/1988 | European Pat. Off. | B41J 3/04 |
| 0653303 A2 | 5/1995 | European Pat. Off. . | |
| 55-69472 | 5/1980 | Japan | B41J 3/04 |
| 4,157,935 | 6/1979 | Solyst | 156/644 |
| 4,169,008 | 9/1979 | Kurth | 156/600 |
| 4,185,290 | 1/1980 | Hoffman | 346/75 |
| 4,187,140 | 2/1980 | Berkenblit et al. | 156/662 |
| 4,209,794 | 6/1980 | Kattner | 346/140 |
| 4,222,060 | 9/1980 | Sato et al. | 346/140 |

*Primary Examiner*—Carl E. Hall
*Assistant Examiner*—Davide Caputo
*Attorney, Agent, or Firm*—Lyon & Lyon LLP

[57] ABSTRACT

The present invention comprises an inkjet print head structure wherein the placement of the transducer electrodes in combination with the particular poling direction of the print head transducer material provides for an efficient combination of shear and normal mode actuation of the print head. The preferred print head structure may be formed as a densely packed linear series of substantially parallel ink channels interspaced between and adjacent to a series of substantially parallel air channels. Further, the present invention provides for a print head structure wherein structures in contact with ink are maintained at ground potential. The present invention provides for a method to manufacture a print head having an array of densely packed ink channels having the characteristics of reduced mechanical crosstalk.

6 Claims, 5 Drawing Sheets

U.S. PATENT DOCUMENTS

| | | | |
|---|---|---|---|
| 4,224,627 | 9/1980 | Powell et al. | 346/75 |
| 4,239,586 | 12/1980 | Ghez et al. | 156/644 |
| 4,245,225 | 1/1981 | Fillmore et al. | 346/75 |
| 4,246,076 | 1/1981 | Gardner | 204/11 |
| 4,248,823 | 2/1981 | Bader et al. | 264/156 |
| 4,250,512 | 2/1981 | Kattner et al. | 346/140 |
| 4,257,052 | 3/1981 | Stoneburner | 346/75 |
| 4,281,333 | 7/1981 | Tsuzuki et al. | 346/140 |
| 4,282,533 | 8/1981 | Brooks et al. | 346/75 |
| 4,284,993 | 8/1981 | Kakeno | 346/75 |
| 4,290,857 | 9/1981 | Ikeda et al. | 204/9 |
| 4,301,585 | 11/1981 | Ikeda | 29/157 |
| 4,330,787 | 5/1982 | Sato et al. | 346/140 |
| 4,334,234 | 6/1982 | Shirato et al. | 346/140 |
| 4,335,389 | 6/1982 | Shirato et al. | 346/140 |
| 4,336,548 | 6/1982 | Matsumoto | 346/140 |
| 4,338,611 | 7/1982 | Eida et al. | 346/75 |
| 4,339,763 | 7/1982 | Kyser et al. | 346/140 |
| 4,343,013 | 8/1982 | Bader et al. | 346/140 |
| 4,357,614 | 11/1982 | Tamai | 346/75 |
| 4,368,476 | 1/1983 | Uehara et al. | 346/140 |
| 4,368,477 | 1/1983 | Heinzi et al. | 346/140 |
| 4,374,707 | 2/1983 | Pollack | 204/11 |
| 4,376,944 | 3/1983 | Reitberger et al. | 346/140 |
| 4,376,945 | 3/1983 | Hara et al. | 346/140 |
| 4,379,304 | 4/1983 | Heinzl et al. | 346/140 |
| 4,388,627 | 6/1983 | Umezawa | 346/75 |
| 4,389,654 | 6/1983 | Bar-on et al. | 346/75 |
| 4,390,883 | 6/1983 | Stoneburner | 346/75 |
| 4,392,145 | 7/1983 | Parkola | 346/140 |
| 4,392,907 | 7/1983 | Shirato et al. | 156/252 |
| 4,394,670 | 7/1983 | Sugitani et al. | 346/140 |
| 4,409,596 | 10/1983 | Ishii | 346/1.1 |
| 4,412,224 | 10/1983 | Sugitani | 346/1.1 |
| 4,413,268 | 11/1983 | Bentin | 346/140 |
| 4,414,552 | 11/1983 | Bergmann et al. | 346/1.1 |
| 4,414,553 | 11/1983 | Perna | 346/1.1 |
| 4,415,909 | 11/1983 | Italiano et al. | 346/140 |
| 4,417,251 | 11/1983 | Sugitani | 346/1.1 |
| 4,418,356 | 11/1983 | Reece | 346/140 |
| 4,420,764 | 12/1983 | Okada | 346/140 |
| 4,421,706 | 12/1983 | Feenstra et al. | 264/157 |
| 4,422,082 | 12/1983 | Louzil | 346/75 |
| 4,424,521 | 1/1984 | Lewis et al. | 346/140 |
| 4,425,777 | 1/1984 | Jeglinski | 72/325 |
| 4,429,317 | 1/1984 | Umezawa et al. | 346/75 |
| 4,429,321 | 1/1984 | Matsumoto | 346/140 |
| 4,429,322 | 1/1984 | Bressier et al. | 346/140 |
| 4,430,784 | 2/1984 | Brooks et al. | 29/157 |
| 4,434,350 | 2/1984 | Flisikowski et al. | 219/121 |
| 4,435,721 | 3/1984 | Tsuzuki et al. | 346/140 |
| 4,437,100 | 3/1984 | Sugitani et al. | 346/1.1 |
| 4,437,103 | 3/1984 | Ikeda | 346/140 |
| 4,437,109 | 3/1984 | Anthony et al. | 357/68 |
| 4,438,191 | 3/1984 | Cloutier et al. | 430/324 |
| 4,446,469 | 5/1984 | Perna | 346/140 |
| 4,447,375 | 5/1984 | Schimmelpfennig | 264/40.5 |
| 4,449,135 | 5/1984 | Umezawa | 346/75 |
| 4,450,455 | 5/1984 | Sugitani et al. | 346/140 |
| 4,450,457 | 5/1984 | Miyachi et al. | 346/140 |
| 4,454,519 | 6/1984 | Oosaka et al. | 346/140 |
| 4,455,192 | 6/1984 | Tamai | 156/628 |
| 4,455,560 | 6/1984 | Louzil | 346/140 |
| 4,456,916 | 6/1984 | Kocot | 346/140 |
| 4,458,256 | 7/1984 | Shirato et al. | 346/140 |
| 4,459,600 | 7/1984 | Sato et al. | 346/140 |
| 4,471,364 | 9/1984 | Kocot | 346/140 |
| 4,480,259 | 10/1984 | Kruger et al. | 346/140 |
| 4,499,479 | 2/1985 | Leee et al. | 346/140 |
| 4,499,480 | 2/1985 | Takatori et al. | 346/140 |
| 4,500,895 | 2/1985 | Buck et al. | 346/140 |
| 4,502,060 | 2/1985 | Rankin et al. | 346/140 |
| 4,509,063 | 4/1985 | Sugitani et al. | 346/140 |
| 4,513,298 | 4/1985 | Scheu | 346/140 |
| 4,513,299 | 4/1985 | Lee et al. | 346/140 |
| 4,514,741 | 4/1985 | Meyer | 346/140 |
| 4,521,786 | 6/1985 | Bain | 346/140 |
| 4,521,787 | 6/1985 | Yokota et al. | 346/140 |
| 4,528,070 | 7/1985 | Gamblin | 204/11 |
| 4,528,574 | 7/1985 | Boyden | 346/140 |
| 4,528,577 | 7/1985 | Cloutier et al. | 346/140 |
| 4,532,530 | 7/1985 | Hawkins | 346/140 |
| 4,535,343 | 8/1985 | Wright et al. | 346/140 |
| 4,536,250 | 8/1985 | Ikeda et al. | 156/651 |
| 4,539,569 | 9/1985 | Watanabe et al. | 346/140 |
| 4,542,389 | 9/1985 | Allen | 346/140 |
| 4,542,391 | 9/1985 | Miyagawa | 346/140 |
| 4,544,932 | 10/1985 | Barnett | 346/140 |
| 4,546,360 | 10/1985 | Fischbeck et al. | 346/1.1 |
| 4,547,330 | 10/1985 | Daughton | 364/261 |
| 4,549,188 | 10/1985 | Shackleton | 346/1.1 |
| 4,550,326 | 10/1985 | Allen et al. | 346/140 |
| 4,555,062 | 11/1985 | You | 239/690 |
| 4,558,330 | 12/1985 | Iizuka et al. | 346/76 |
| 4,558,333 | 12/1985 | Sugitani et al. | 346/140 |
| 4,564,846 | 1/1986 | Siegal | 346/75 |
| 4,567,493 | 1/1986 | Ikeda et al. | 346/140 |
| 4,568,953 | 2/1986 | Aoki et al. | 346/140 |
| 4,570,167 | 2/1986 | Sugitani et al. | 346/140 |
| 4,571,599 | 2/1986 | Rezanka | 346/140 |
| 4,574,445 | 3/1986 | Bentin et al. | 29/157 |
| 4,576,111 | 3/1986 | Slomianny | 118/313 |
| 4,577,202 | 3/1986 | Hara | 346/140 |
| 4,578,687 | 3/1986 | Cloutier et al. | 346/140 |
| 4,580,148 | 4/1986 | Domoto et al. | 346/140 |
| 4,580,149 | 4/1986 | Domoto et al. | 346/140 |
| 4,583,690 | 4/1986 | You | 239/690 |
| 4,587,534 | 5/1986 | Saito et al. | 346/140 |
| 4,589,000 | 5/1986 | Koto et al. | 346/140 |
| 4,591,883 | 5/1986 | Isayama | 346/140 |
| 4,595,937 | 6/1986 | Conta et al. | 346/140 |
| 4,595,938 | 6/1986 | Conta et al. | 346/140 |
| 4,596,994 | 6/1986 | Matsuda et al. | 346/140 |
| 4,601,777 | 7/1986 | Hawkins et al. | 156/626 |
| 4,602,261 | 7/1986 | Matsuda et al. | 346/140 |
| 4,609,427 | 9/1986 | Inamoto et al. | 156/633 |
| 4,610,202 | 9/1986 | Ebinuma et al. | 101/364 |
| 4,611,219 | 9/1986 | Sugitani et al. | 346/140 |
| 4,612,554 | 9/1986 | Poleshuk | 346/140 |
| 4,616,408 | 10/1986 | Lloyd | 29/611 |
| 4,621,273 | 11/1986 | Anderson | 346/140 |
| 4,623,906 | 11/1986 | Chandrashekhar et al. | 346/140 |
| 4,625,373 | 12/1986 | Duffield et al. | 29/25.35 |
| 4,626,875 | 12/1986 | Hara et al. | 346/140 |
| 4,628,333 | 12/1986 | Terasawa | 346/140 |
| 4,630,077 | 12/1986 | Berruti et al. | 346/140 |
| 4,630,078 | 12/1986 | Watanabe | 346/140 |
| 4,631,553 | 12/1986 | Sekiya | 346/140 |
| 4,631,555 | 12/1986 | Ikeda et al. | 346/140 |
| 4,635,073 | 1/1987 | Hanson | 346/1.1 |
| 4,635,077 | 1/1987 | Itoh | 346/140 |
| 4,638,328 | 1/1987 | Drake et al. | 346/75 |
| 4,638,337 | 1/1987 | Torpey et al. | 346/140 |
| 4,639,748 | 1/1987 | Drake et al. | 346/140 |
| 4,643,948 | 2/1987 | Diaz et al. | 428/422 |
| 4,646,110 | 2/1987 | Ikeda et al. | 346/140 |
| 4,651,174 | 3/1987 | Bava et al. | 346/140 |
| 4,663,640 | 5/1987 | Ikeda | 346/140 |
| 4,666,823 | 5/1987 | Yokota et al. | 430/320 |
| 4,672,397 | 6/1987 | Suga et al. | 346/140 |
| 4,675,043 | 6/1987 | Conta et al. | 65/160 |
| 4,675,083 | 6/1987 | Bearss et al. | 204/11 |

4,678,529 7/1987 Drake et al. ..... 156/234
4,680,593 7/1987 Takeno et al. ..... 346/76
4,680,595 7/1987 Cruz-Uribe et al. ..... 346/140
4,680,859 7/1987 Johnson ..... 29/611
4,683,481 7/1987 Johnson ..... 346/140
4,685,185 8/1987 Boso et al. ..... 29/157
4,686,544 8/1987 Ikeda et al. ..... 346/140
4,688,052 8/1987 Inamoto et al. ..... 346/140
4,688,053 8/1987 Noguchi et al. ..... 346/140
4,688,054 8/1987 Inamoto et al. ..... 346/140
4,688,055 8/1987 Noguchi et al. ..... 346/140
4,688,056 8/1987 Noguchi et al. ..... 346/140
4,689,640 8/1987 Shimomura ..... 346/140
4,689,641 8/1987 Scardovi et al. ..... 346/140
4,689,642 8/1987 Sugitani ..... 346/140
4,694,306 9/1987 Ikeda et al. ..... 346/140
4,694,308 9/1987 Chan et al. ..... 346/140
4,695,853 9/1987 Hackleman et al. ..... 346/140
4,698,645 10/1987 Inamoto ..... 346/140
4,701,766 10/1987 Sugitani et al. ..... 346/1.1
4,703,332 10/1987 Crotti et al. ..... 346/140
4,707,705 11/1987 Hara et al. ..... 346/75
4,716,423 12/1987 Chan et al. ..... 346/140
4,719,472 1/1988 Arakawa ..... 346/140
4,719,477 1/1988 Hess ..... 346/140
4,719,478 1/1988 Tachihara et al. ..... 346/140
4,720,716 1/1988 Ikeda et al. ..... 346/140
4,723,129 2/1988 Endo et al. ..... 346/1.1
4,723,131 2/1988 Droit ..... 346/75
4,723,136 2/1988 Suzumura ..... 346/140
4,725,851 2/1988 Sutera et al. ..... 346/75
4,725,859 2/1988 Shibata et al. ..... 346/140
4,725,862 2/1988 Matsuzaki ..... 346/140
4,727,012 2/1988 Quella et al. ..... 430/320
4,727,379 2/1988 Sourlis et al. ..... 346/75
4,727,384 2/1988 Tsuda ..... 346/140
4,728,392 3/1988 Miura et al. ..... 156/644
4,730,196 3/1988 van Esdonk et al. ..... 346/140
4,733,447 3/1988 Ageishi ..... 29/157
4,733,823 3/1988 Waggener et al. ..... 239/601
4,734,563 3/1988 Lloyd ..... 219/543
4,734,717 3/1988 Rayfield ..... 346/140
4,736,212 4/1988 Oda et al. ..... 346/140
4,740,796 4/1988 Endo et al. ..... 346/1.1
4,740,800 4/1988 Kyoshima ..... 346/140
4,746,935 5/1988 Allen ..... 346/140
4,752,787 6/1988 Matsumoto et al. ..... 346/140
4,768,044 8/1988 Shimosato et al. ..... 346/140
4,769,654 9/1988 Tanaka et al. ..... 346/140
4,771,295 9/1988 Baker et al. ..... 346/1.1
4,771,298 9/1988 Lee et al. ..... 346/140
4,774,530 9/1988 Hawkins ..... 346/140
4,777,494 10/1988 Shibata et al. ..... 346/1.1
4,785,311 11/1988 Kaneko et al. ..... 346/1.1
4,786,303 11/1988 Padalino ..... 65/4.21
4,786,357 11/1988 Campanelli et al. ..... 156/633
4,789,425 12/1988 Drake et al. ..... 156/644
4,789,871 12/1988 Uddgren ..... 346/75
4,791,436 12/1988 Chan et al. ..... 346/140
4,791,438 12/1988 Hanson et al. ..... 346/140
4,791,440 12/1988 Eldridge et al. ..... 346/140
4,792,818 12/1988 Eldridge et al. ..... 346/140
4,794,409 12/1988 Gowger et al. ..... 346/140
4,794,410 12/1988 Taub et al. ..... 346/140
4,794,411 12/1988 Taub et al. ..... 346/140
4,801,947 1/1989 Lichtenberger et al. ..... 346/75
4,803,499 2/1989 Hayamizu ..... 346/140
4,806,032 2/1989 Gragg et al. ..... 400/194
4,806,106 2/1989 Mebane et al. ..... 439/77
4,808,260 2/1989 Sickafus et al. ..... 156/644
4,809,017 2/1989 Fost ..... 346/75
4,809,024 2/1989 DeYoung et al. ..... 346/140
4,809,428 3/1989 Aden et al. ..... 29/611
4,812,859 3/1989 Chan et al. ..... 346/140
4,825,227 4/1989 Fischbeck et al. ..... 346/1.1
4,827,289 5/1989 Tsuji et al. ..... 346/76
4,827,294 5/1989 Hanson ..... 346/140
4,829,319 5/1989 Chan et al. ..... 346/1.1
4,829,324 5/1989 Drake et al. ..... 346/140
4,831,390 5/1989 Deshpande et al. ..... 346/140
4,831,391 5/1989 Asai ..... 346/140
4,835,553 5/1989 Torpey et al. ..... 346/140
4,839,001 6/1989 Bakewell ..... 204/11
4,839,668 6/1989 Sato et al. ..... 346/140
4,839,669 6/1989 Sato et al. ..... 346/140
4,842,493 6/1989 Nilsson ..... 417/322
4,843,407 6/1989 Archer et al. ..... 346/75
4,847,630 7/1989 Bhaskar et al. ..... 346/1.1
4,847,636 7/1989 Durbeck et al. ..... 346/140
4,847,639 7/1989 Sugata et al. ..... 346/140
4,849,773 7/1989 Owatari ..... 346/140
4,849,774 7/1989 Endo et al. ..... 346/140
4,851,371 7/1989 Fisher et al. ..... 437/226
4,853,718 8/1989 ElHatem et al. ..... 346/140
4,860,033 8/1989 Shiozaki et al. ..... 346/140
4,862,197 8/1989 Stoffel ..... 346/140
4,863,560 9/1989 Hawkins ..... 156/644
4,864,329 9/1989 Kneezel et al. ..... 346/140
4,866,460 9/1989 Shiozaki ..... 346/140
4,866,461 9/1989 Piatt ..... 346/140
4,870,433 9/1989 Campbell et al. ..... 346/140
4,873,622 10/1989 Komuro et al. ..... 346/140
4,875,059 10/1989 Masuda et al. ..... 346/140
4,875,619 10/1989 Anderson et al. ..... 228/190
4,875,968 10/1989 O'Neill et al. ..... 156/633
4,878,070 10/1989 Watrobski ..... 346/140
4,878,992 11/1989 Campanelli ..... 156/633
4,879,568 11/1989 Bartky et al. ..... 346/140
4,881,318 11/1989 Komuro et al. ..... 29/827
4,882,595 11/1989 Trueba et al. ..... 346/140
4,883,219 11/1989 Anderson et al. ..... 228/190
4,885,932 12/1989 Heffeman et al. ..... 73/53
4,887,098 12/1989 Hawkins et al. ..... 346/140
4,887,099 12/1989 Terai et al. ..... 346/140
4,889,587 12/1989 Komuro ..... 156/643
4,890,126 12/1989 Hotomi ..... 346/140
4,894,664 1/1990 Tsung Pan ..... 346/1.1
4,896,171 1/1990 Ito ..... 346/140
4,897,674 1/1990 Hirasawa ..... 346/140
4,899,178 2/1990 Tellier ..... 346/140
4,899,179 2/1990 Marchetti ..... 346/140
4,899,180 2/1990 Elhatem et al. ..... 346/140
4,899,181 2/1990 Hawkins et al. ..... 346/140
4,901,091 2/1990 Kasamoto ..... 346/140
4,905,017 2/1990 Sugitani et al. ..... 346/1.1
4,907,020 3/1990 Shiozaki ..... 346/140
4,914,562 4/1990 Abe et al. ..... 346/140
4,914,736 4/1990 Matsuda ..... 346/140
4,915,718 4/1990 Desai ..... 65/31
4,916,468 4/1990 Hayamizu ..... 346/140
4,920,362 4/1990 Cowger ..... 346/140
4,922,265 5/1990 Pan ..... 346/1.1
4,922,269 5/1990 Ikdea et al. ..... 346/140
4,924,241 5/1990 Parks et al. ..... 346/75
4,926,197 5/1990 Childers et al. ..... 346/140
4,929,964 5/1990 Sato et al. ..... 346/1.1
4,929,968 5/1990 Ishikawa ..... 346/140
4,929,969 5/1990 Morris ..... 346/140
4,931,811 6/1990 Cowger et al. ..... 346/140
4,931,812 6/1990 Dunn et al. ..... 346/140
4,931,813 6/1990 Pan et al. ..... 346/140
4,935,750 6/1990 Hawkins ..... 346/140
4,935,752 6/1990 Hawkins ..... 346/140
4,936,952 6/1990 Komuro ..... 156/643

4,937,596 6/1990 Schmid ..... 346/140
4,940,996 7/1990 Paton et al. ..... 346/140
4,940,999 7/1990 Ikeda et al. ..... 346/140
4,942,408 7/1990 Braun ..... 346/140
4,942,409 7/1990 Paton et al. ..... 346/140
4,947,184 8/1990 Moynihan ..... 346/1.1
4,947,189 8/1990 Braun et al. ..... 346/140
4,947,192 8/1990 Hawkins et al. ..... 346/140
4,947,193 8/1990 Deshpande ..... 346/140
4,949,102 8/1990 Braun .
4,951,063 8/1990 Hawkins et al. ..... 346/1.1
4,953,287 9/1990 West et al. ..... 29/611
4,954,225 9/1990 Bakewell ..... 204/11
4,956,653 9/1990 Braun ..... 346/140
4,956,654 9/1990 Komuro et al. ..... 346/140
4,957,592 9/1990 O'Neill ..... 156/644
4,961,076 10/1990 Cowger ..... 346/1.1
4,961,821 10/1990 Drake et al. ..... 156/647
4,962,391 10/1990 Kitahara et al. ..... 346/140
4,963,883 10/1990 Matsui ..... 346/1.1
4,963,897 10/1990 Kattner ..... 346/140
4,965,594 10/1990 Komuro ..... 346/140
4,965,595 10/1990 Yoshimura ..... 346/140
4,965,611 10/1990 Pan et al. ..... 346/1.1
4,967,208 10/1990 Childers ..... 346/140
4,968,992 11/1990 Komuro ..... 346/1.1
4,970,532 11/1990 Komuro et al. ..... 346/140
4,971,665 11/1990 Sexton ..... 204/11
4,972,204 11/1990 Sexton ..... 346/75
4,980,703 12/1990 Sakurai ..... 346/140
4,985,710 1/1991 Drake et al. ..... 346/1.1
4,989,017 1/1991 Oda et al. ..... 346/76
4,990,939 2/1991 Sekiya et al. ..... 346/140
4,992,802 2/1991 Dion et al. ..... 346/1.1
4,994,824 2/1991 Winslow ..... 346/140
4,994,825 2/1991 Saito et al. ..... 346/140
4,994,826 2/1991 Tellier ..... 346/140
4,999,650 3/1991 Braun ..... 346/140
5,000,811 3/1991 Campanelli ..... 156/264
5,003,679 4/1991 Bartky et al. ..... 29/400
5,006,202 4/1991 Hawkins et al. ..... 156/644
5,006,870 4/1991 Hirahara et al. ..... 346/76
5,008,689 4/1991 Pan et al. ..... 346/140
5,010,354 4/1991 Cowger et al. ..... 346/140
5,010,355 4/1991 Hawkins et al. ..... 346/140
5,010,356 4/1991 Albinson ..... 346/140
5,013,383 5/1991 Chapman ..... 156/307.3
5,016,023 5/1991 Chan et al. ..... 346/1.1
5,016,024 5/1991 Lam et al. ..... 346/1.1
5,017,941 5/1991 Drake ..... 346/1.1
5,017,946 5/1991 Masuda et al. ..... 346/140
5,017,947 5/1991 Masuda ..... 346/140
5,019,675 5/1991 Blessington et al. ..... 346/140
5,021,809 6/1991 Abe et al. ..... 346/140
5,023,630 6/1991 Moriyama ..... 346/140
5,025,271 6/1991 Baker et al. ..... 346/140
5,028,514 7/1991 Johannsen ..... 430/320
5,030,971 7/1991 Drake et al. ..... 346/140
5,036,337 7/1991 Rezanka ..... 346/1.1
5,039,999 8/1991 Winslow et al. ..... 346/140
5,040,001 8/1991 Dunn et al. ..... 346/140
5,040,002 8/1991 Pollacek et al. ..... 346/140
5,041,190 8/1991 Drake et al. ..... 156/647
5,041,844 8/1991 Deshpande ..... 346/1.1
5,043,747 8/1991 Ebisawa et al. ..... 346/140
5,045,870 9/1991 Lamey et al. ..... 346/140
5,047,790 9/1991 Cowger et al. ..... 346/140
5,049,231 9/1991 Shibata ..... 156/630
5,051,759 9/1991 Karita et al. ..... 346/140
5,057,853 10/1991 Fisher ..... 346/140
5,057,855 10/1991 Damouth ..... 346/140
5,057,856 10/1991 Takagi et al. ..... 346/140
5,059,973 10/1991 Watanabe ..... 346/1.1
5,059,989 10/1991 Eldridge et al. ..... 346/140
5,062,937 11/1991 Komuro ..... 204/192.15
5,063,393 11/1991 Clark et al. ..... 346/75
5,066,533 11/1991 America et al. ..... 428/156
5,066,963 11/1991 Kimura et al. ..... 346/140
5,066,964 11/1991 Fukuda et al. ..... 346/140
5,068,006 11/1991 Fisher ..... 156/633
5,073,785 12/1991 Jansen et al. ..... 346/1.1
5,075,250 12/1991 Hawkins et al. ..... 437/52
5,081,473 1/1992 Hawkins et al. ..... 346/140
5,081,474 1/1992 Shibata et al. ..... 346/140
5,083,137 1/1992 Badyal et al. ..... 346/1.1
5,086,307 2/1992 Noguchi et al. ..... 346/140
5,087,930 2/1992 Roy et al. ..... 346/140
5,095,321 3/1992 Saito et al. ..... 346/140
5,097,275 3/1992 Takita ..... 346/140
5,103,243 4/1992 Cowger ..... 346/1.1
5,103,246 4/1992 Dunn ..... 346/140
5,107,281 4/1992 Takahashi ..... 346/140
5,113,203 5/1992 Takagi et al. ..... 346/140
5,113,205 5/1992 Sato et al. ..... 346/140
5,119,115 6/1992 Buat et al. ..... 346/140
5,121,132 6/1992 Pan et al. ..... 346/1.1
5,121,143 6/1992 Hayamizu ..... 346/140
5,122,812 6/1992 Hess et al. ..... 346/1.1
5,124,716 6/1992 Roy et al. ..... 346/1.1
5,124,717 6/1992 Campanelli et al. ..... 346/1.1
5,126,755 6/1992 Sharpe et al. ..... 346/75
5,126,768 6/1992 Nozawa et al. ..... 346/140
5,132,707 7/1992 O'Neill ..... 346/140
5,136,310 8/1992 Drews ..... 346/140
5,140,345 8/1992 Komuro ..... 346/140
5,141,596 8/1992 Hawkins et al. ..... 156/628
5,142,298 8/1992 Hoffmann et al. ..... 346/1.1
5,142,300 8/1992 Aoki ..... 346/76
5,142,308 8/1992 Hasegawa et al. ..... 346/140
5,148,192 9/1992 Izumida et al. ..... 346/140
5,149,419 9/1992 Sexton et al. ..... 205/75
5,150,132 9/1992 Shimomura et al. ..... 346/140
5,153,610 10/1992 Komuro et al. ..... 346/140
5,153,612 10/1992 Dunn et al. ..... 346/140
5,154,815 10/1992 O'Neill ..... 205/75
5,155,502 10/1992 Kimura et al. ..... 346/140
5,157,411 10/1992 Takekoshi et al. ..... 346/1.1
5,157,418 10/1992 Tamura ..... 346/140
5,157,419 10/1992 Matsumoto et al. ..... 346/140
5,157,420 10/1992 Naka et al. ..... 346/140
5,159,353 10/1992 Fasen et al. ..... 346/140
5,159,354 10/1992 Hirasawa et al. ..... 346/140
5,160,403 11/1992 Fisher et al. ..... 156/633
5,160,577 11/1992 Deshpande ..... 156/644
5,162,818 11/1992 Karita et al. ..... 346/140
5,163,177 11/1992 Komura ..... 346/1.1
5,164,747 11/1992 Osada et al. ..... 346/140
5,169,806 12/1992 Hawkins et al. ..... 437/233
5,170,177 12/1992 Stanley et al. ..... 346/1.1
5,172,139 12/1992 Sekiya et al. ..... 346/140
5,175,565 12/1992 Ishinaga et al. ..... 346/140
5,175,567 12/1992 Asai ..... 346/140
5,182,577 1/1993 Ishinaga et al. ..... 346/140
5,182,579 1/1993 Haruta et al. ..... 346/140
5,182,581 1/1993 Kashimura et al. ..... 346/140
5,187,499 2/1993 Murakami ..... 346/140
5,187,500 2/1993 Bohorquez et al. ..... 346/140
5,189,437 2/1993 Michaelis et al. ..... 346/1.1
5,189,438 2/1993 Hine et al. ..... 346/1.1
5,189,443 2/1993 Arashima et al. ..... 346/140
5,189,787 3/1993 Reed et al. ..... 29/831
5,191,360 3/1993 Pohlig ..... 346/140
5,194,877 3/1993 Lam et al. ..... 346/1.1
5,198,834 3/1993 Childers et al. ..... 346/1.1

5,202,659 4/1993 DeBonte et al. ..... 346/1.1
5,204,689 4/1993 Shirato et al. ..... 346/1.1
5,204,690 4/1993 Lorenze, Jr. et al. ..... 346/1.1
5,206,667 4/1993 Yano ..... 346/140
5,208,604 5/1993 Watanabe et al. ..... 346/1.1
5,208,605 5/1993 Drake ..... 346/1.1
5,208,611 5/1993 Kappel et al. ..... 346/140
5,208,980 5/1993 Hayes ..... 29/890.1
5,210,549 5/1993 Takahashi ..... 346/140
5,211,754 5/1993 Komuro ..... 118/300
5,211,806 5/1993 Wong et al. ..... 156/644
5,212,496 5/1993 Badesha et al. ..... 346/1.1
5,212,503 5/1993 Saito et al. ..... 346/140
5,214,449 5/1993 Buhler ..... 346/140
5,216,446 6/1993 Satoi et al. ..... 346/140
5,216,447 6/1993 Fujita et al. ..... 346/140
5,216,450 6/1993 Koitabashi et al. ..... 346/140
5,218,381 6/1993 Narang et al. ..... 346/140
5,218,754 6/1993 Rangappan ..... 29/611
5,229,785 7/1993 Leban ..... 346/1.1
5,230,926 7/1993 Narang et al. ..... 427/289
5,233,369 8/1993 Carlotta et al. ..... 346/140
5,235,352 8/1993 Pies et al. ..... 346/140
5,237,342 8/1993 Saikawa et al. ..... 346/140
5,237,343 8/1993 Osada ..... 346/140
5,243,363 9/1993 Koizumi et al. ..... 346/140
5,243,755 9/1993 Inabq et al. ..... 29/890.1
5,255,017 10/1993 Lam ..... 346/140
5,255,022 10/1993 Burolla ..... 346/140
5,257,042 10/1993 Buhler ..... 346/140
5,257,043 10/1993 Kneezel ..... 346/140
5,258,774 11/1993 Rogers ..... 346/1.1
5,258,781 11/1993 John ..... 346/140
5,262,802 11/1993 Karita et al. ..... 346/140
5,263,250 11/1993 Nishiwaki et al. ..... 29/890.1
5,264,874 11/1993 Matsumoto et al. ..... 346/140
5,272,491 12/1993 Asakawa et al. ..... 346/140
5,277,754 1/1994 Hadimioglu et al. ..... 156/644
5,278,584 1/1994 Keefe et al. ..... 346/140
5,278,585 1/1994 Karz et al. ..... 346/140
5,285,215 2/1994 Liker ..... 346/1.1
5,287,126 2/1994 Quate ..... 346/140
5,306,370 4/1994 Herko et al. ..... 156/155
5,322,594 6/1994 Bol ..... 156/634
5,361,084 11/1994 Paton et al. ..... 347/15
5,385,635 1/1995 O'Neill ..... 156/647
5,412,412 5/1995 Drake et al. ..... 347/40
5,450,108 9/1995 Drake et al. ..... 347/65
5,461,403 10/1995 Wallace et al. ..... 347/10
5,487,483 1/1996 Kubby ..... 216/27
5,495,270 2/1996 Burr et al. ..... 347/10
5,504,507 4/1996 Watrobski et al. ..... 347/19
5,534,901 7/1996 Drake ..... 347/63
5,589,864 12/1996 Hadimioglu ..... 347/46

INKJET PRINT HEAD APPARATUS

RELATED APPLICATIONS

This application is a Divisional application of copending prior application Ser. No. 08/703,924, filed on Aug. 27, 1996.

BACKGROUND OF THE INVENTION

1. Field of the Invention

The present invention pertains to the field of inkjet printers, and more specifically, to piezoelectric inkjet print heads.

2. Description of Related Art

Ink jet printers, and more particularly, drop-on-demand inkjet print heads having a piezoelectric transducer actuated by electrical signals, are known in the art. Typical print heads consist of a transducer mechanically coupled to an ink chamber, wherein the application of an electrical signal to the transducer material causes the transducer to deform in shape or dimension within or into the ink chamber, thereby resulting in the expulsion of ink from an ink chamber orifice. One disadvantage of prior art print head structures is that they are relatively large in overall dimension, and thus cannot be placed together into a densely packed array; this reduces available output dot density, which will decrease the overall output definition of a printer. Another disadvantage with prior art devices is that the large number of components in these devices tend to increase the costs and difficulty of manufacture. Further, the prior art structures, when placed next to each other within an array to create a multi-channel print head, tend to produce undesirable "crosstalk" between adjacent ink chambers, which interfaces with the accurate ejection of ink from the print head.

Therefore, there is a need in the art for a print head structure which can be advantageously and economically manufactured, but can also be placed in a densely packed array of such structures for a multiple-channel print head for increased output dot density. Further, there is a need for a multi-channel print head structure which minimizes undesirable crosstalk effects.

SUMMARY OF THE INVENTION

The present invention comprises an inkjet print head wherein the placement of the transducer electrodes in combination with the particular poling direction (overall polarization direction) of the print head transducer material provides for an efficient combination of shear and normal mode actuation of the print head. According to one embodiment of the invention, a print head transducer is defined by a first wall portion, a second wall portion, and a base portion, in which the interior walls of these wall and base portions form three sides of an ink channel. The upper surfaces of the wall portions define a first face of the print head transducer, and the lower surface of the base portion defines a second, opposite face of the transducer. A metallization layer, forming a common electrode, is deposited on the interior surfaces of the ink channel and along the upper surfaces of the first and second wall portions. A second metallization layer, forming the addressable electrode, is deposited on the entire outer surface of the base portion, and on a portion of the outer surfaces of the first and second wall portions. The poling direction of the piezoelectric material forming the print head transducer is substantially perpendicular to the electric field direction between the addressable electrodes and the common electrode at the first and second wall portions, providing for shear mode deflection of the wall portions, toward or away from each other, upon the application of an electrical drive signal to the addressable electrodes. The poling direction of the piezoelectric material forming the print head transducer is substantially parallel to the electric field direction between the addressable electrodes and the common electrode at the center of the base portion, providing for normal mode actuation of the center of the base portion when an electrical drive signal is applied. The metallization layer forming the addressable electrodes preferably extends halfway along the height of the wall portions. The metallization layer forming the common electrode is preferably maintained at ground potential.

The present invention also comprises a plurality of ink ejecting structures capable of being densely packed into a linear array of multiple ink channels. This array comprises a transducer formed from a sheet, wafer or block of piezoelectric material, into which a series of ink channels are cut into a first face of the piezoelectric sheet material. A second opposite face of the piezoelectric sheet contains a series of air channels, each of which are interspaced between each of the ink channels. A metallization layer forming the common electrode is coated over the first face of the sheet and on the interior surface of each ink channel. A second metallization layer forming the addressable electrodes is coated over the second face and on the interior surface of each air channel, with the second metallization layer initially connected from air channel to air channel. An electrode-separation channel is cut into the bottom of each air channel, which breaks the connection of the second metallization layer between adjacent air channels, and which also extends the gap depth within the combined air/electrode-separation channels further toward the first face of the piezoelectric block. This transducer structure for an array of ink channels is particularly advantageous in that it provides for minimal mechanical crosstalk between adjacent ink channels. An alternate embodiment further minimizes crosstalk, by feeding ink from an ink reservoir to the ink channels via one or more slotted ink passages, which serve to reduce the transfer of pressure waves from one ink channel another.

These and other aspects of the present invention are described more fully in following specification and illustrated in the accompanying drawings figures.

DESCRIPTION OF THE PREFERRED EMBODIMENT

Figure 1:
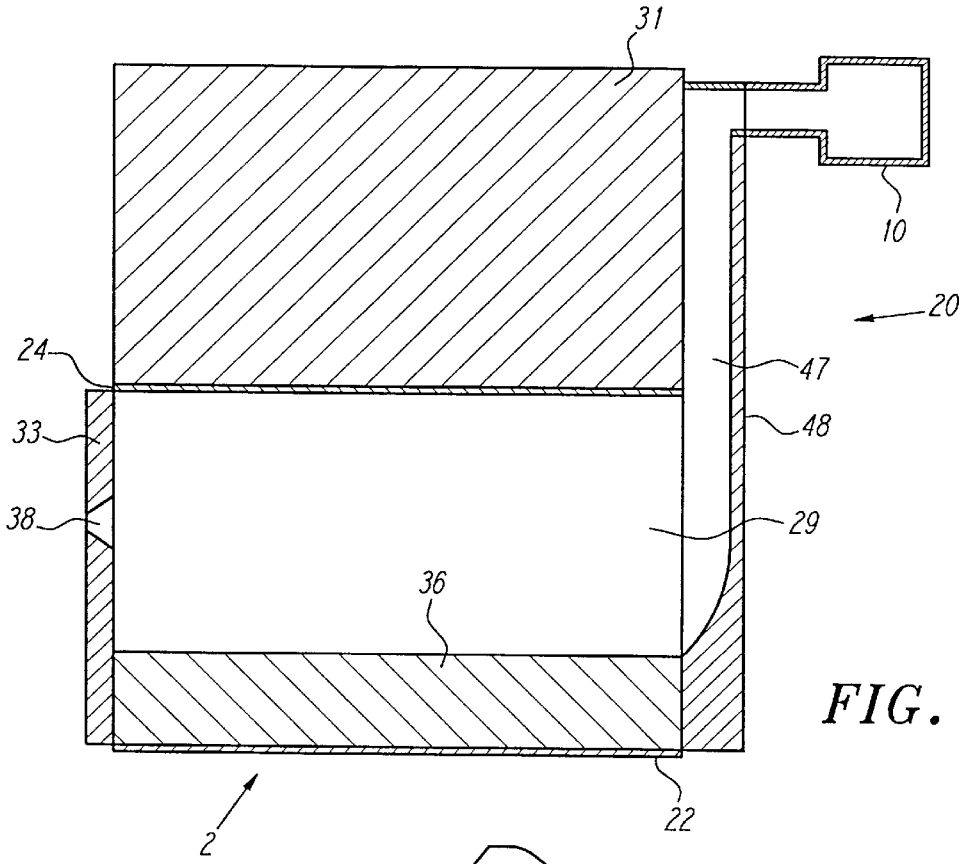
FIG. 1 is a cross-sectional side view of an inkjet print head structure for a single ink channel according to an embodiment of the invention.

FIG. 1 is a cross-sectional side view of a single channel of an inkjet print head structure 20 for a piezoelectric inkjet printer constructed in accordance with an embodiment of the present invention. Print head structure 20 comprises a print head transducer 2, formed of a piezoelectric material, into which is cut an ink channel 29. The ink channel 29 is bordered along one end with a nozzle plate 33 having an orifice 38 defined therethrough. A rear cover plate 48 is suitably secured to the other end of ink channel 29. A base portion 36 of the print head transducer 2 forms the floor of the ink channel 29, while an ink channel cover 31 is secured to the upper opening of the print head transducer 2. Ink channel 29 is supplied with ink from an ink reservoir 10 through ink feed passage 47 in rear cover plate 48. As explained in more detail below, the actuation of the print head transducer 2 results in the expulsion of ink drops from ink channel 29 through the orifice 38 in nozzle plate 33.

Figure 2:
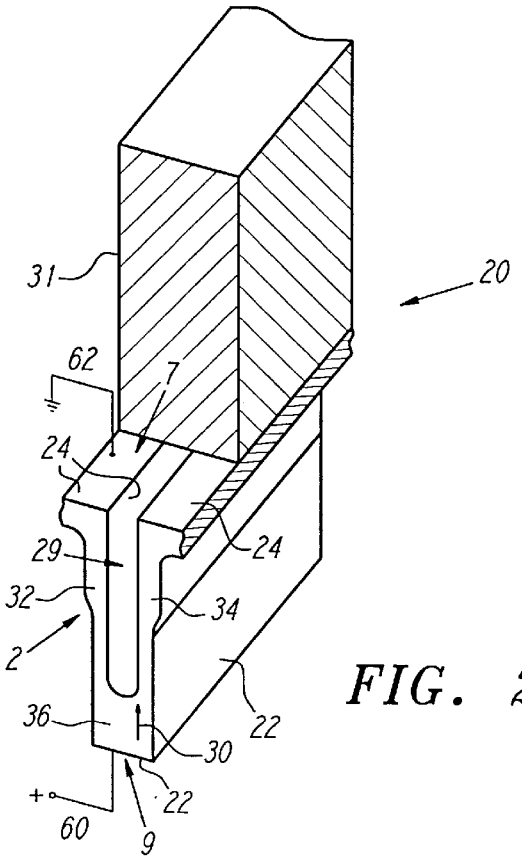
FIG. 2 is a partial perspective view of the inkjet print head structure of FIG. 1.

Referring to FIG. 2, the print head transducer 2 of FIG. 1 is shown in greater detail. The preferred print head transducer 2 comprises a first wall portion 32, a second wall portion 34, and a base portion 36. The upper surfaces of the first and second wall portions 32 and 34 define a first face 7 of the printed head transducer 2, and the lower surface of the base portion 36 defines a second, opposite face 9 of the print head transducer 2. Ink channel 29 is defined on three sides by the inner surface of the base portion 36 and the inner wall surfaces of the wall portions 32 and 34, and is an elongated channel cut into the piezoelectric material of the print head transducer 2, leaving a lengthwise opening along the upper first face 7 of the print head transducer 2. As described above, one end of ink channel 29 is closed off by an nozzle plate 33 (FIG. 1) while the other end is closed off by a rear cover plate 48 (plates 33 and 48 are not shown in FIG. 2). A metallization layer 24 coats the inner surfaces of ink channel 29 and is also deposited along the upper surfaces of the first wall portion 32 and second wall portion 34. An ink channel cover 31 is bonded over the first face 7 of the print head transducer 2, to close off the lengthwise lateral opening in the ink channel 29. A second metallization layer 22 coats the outer surfaces of the base portion 36, and also extends approximately halfway up each of the outer surfaces of the first and second wall portions 32 and 34.

The metallization layer 22 defines an addressable electrode 60, which is connected to an external signal source to provide electrical drive signals to actuate the piezoelectric material of print head transducer 2. In the preferred embodiment, the metallization layer 24 defines a common electrode 62 which is maintained at ground potential. Alternatively, the common electrode 62 may also be connected to an external voltage source to receive electrical drive signals. However, it is particularly advantageous to maintain the common electrode 62 at ground potential since the metallization layer 24 is in contact with the ink within ink channel 29. Having the common electrode at ground minimizes possible electrolysis effects upon the common electrode 62 and the ink within ink channel 29, which may degrade the performance and structure of both the common electrode 62 and/or the ink.

The preferred piezoelectric material forming the print head transducer 2 is PZT, although other piezoelectric materials may also be employed in the present invention. The overall polarization vector direction ("poling direction") of print head transducer 2 lies substantially in the direction shown by the arrow 30 in FIG. 2, extending in a perpendicular direction from the second face 9 to the first face 7 of the print head transducer 2. The print head transducer 2 may have other poling directions within the scope of the present invention, including, but not limited to, a poling direction which lies substantially opposite (approximately 180 degrees) to the direction indicated by the arrow 30 in FIG. 2.

In the preferred embodiment, print head transducer 2 is preferably formed from a singe piece of piezoelectric material, rather than an assembly of separate components which are secured together into the desired structure (i.e., where the respective wall portions are distinct components which are bonded or glued to a separate base portion). By forming the entire print head transducer 2 from a single piece of piezoelectric material, the deflection capability of the print head transducer 2 is thus not limited by the strength or stiffness of glue lines or joints between different transducer components.

In operation, the present invention works upon the principle of the piezoelectric effect, where the application of an electrical signal across certain faces of piezoelectric materials produces a corresponding mechanical distortion or strain in that material. In general, and of particular importance to the present invention, the mechanical reaction of a piezoelectric material to an electrical signal is heavily dependent upon the poling direction of the piezoelectric material, as well as the orientation of the applied electrical field to that piezoelectric material.

Figure 4A:
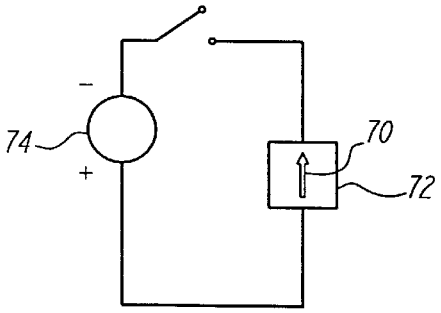
FIG. 4A–B illustrate the normal mode actuation of a block of piezoelectric material.
Figure 4B:
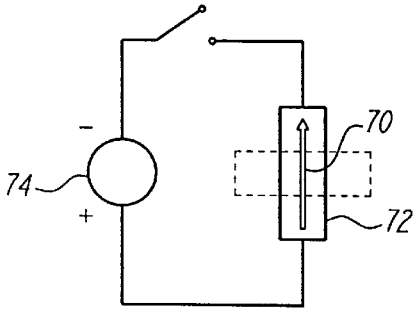

FIGS. 4A and 4B depict the normal mode actuation of a typical piezoelectric material. In FIG. 4A, the piezoelectric material 72 has a poling direction as indicated by arrow 70. A voltage source 74 is connected across two exterior faces of piezoelectric material 72, with the voltage source 74 applying an electric field parallel to the poling direction 70 of the material 72. As shown in FIG. 4B, this electric field causes a normal mode mechanical distortion of the piezoelectric material 72, wherein one polarity of the applied voltage will cause material 72 to elongate, becoming longer and thinner parallel to the poling direction 70 of the piezoelectric material 72. The application of an opposite polarity voltage will cause material 72 to compress, becoming shorter and thicker, also parallel to the poling direction 70 of the piezoelectric material 72 (as shown in dashed lines in FIG. 4B).

Figure 5A:
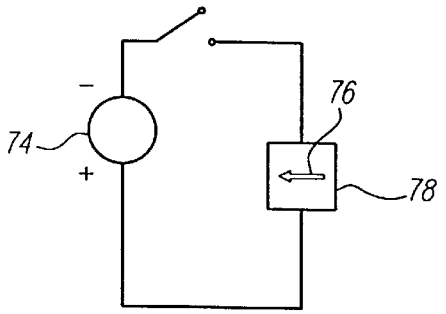
FIG. 5A–B illustrate the shear mode actuation of a block of piezoelectric material.
Figure 5B:
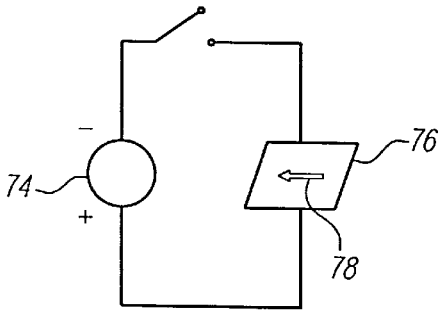

FIGS. 5A and 5B depict the shear mode actuation of a typical piezoelectric material 76. In FIG. 5A, the piezoelectric material 76 has a poling direction as indicated by arrow 78. This time, however, the voltage source 74 is connected across the piezoelectric material 76 such that the application of voltage by the voltage source 74 creates an electric field which runs perpendicular to the poling direction of the piezoelectric material 76. As shown in FIG. 5*b*, this electric field causes a shear mode mechanical distortion of the piezoelectric material 76, which causes material 76 to generally react by deflecting towards a parallelogram shape, rather than the elongated or compressed reaction of the normal mode. Depending upon the manner in which material 76 is restrained or held by an external force, the material 76 may deform in a bending or twisting manner. The particular direction, type of movement, and field of movement for this mechanical distortion is dictated in part by the shape, dimensions and/or composition of the piezoelectric material 76, and also by the amplitude, polarity or frequency of the electrical signal which is applied to the material 76. In general, an applied voltage of one polarity will cause material 76 to bend in a first direction, and an applied voltage of the opposite polarity will cause material 76 to bend in a second direction opposite that of the first.

Figure 6:
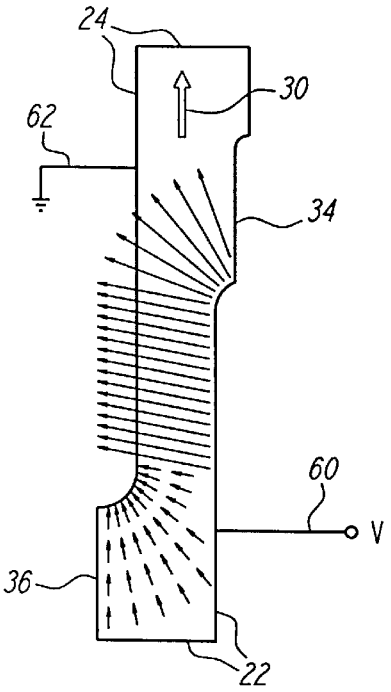
FIG. 6 is a partial diagram of the preferred print head transducer structure showing electric fields established therein.

FIG. 6 is a front view of one-half of the piezoelectric material for the preferred single channel print head transducer 2 (i.e., one wall portion and one-half of the base portion). As stated above, metallization layer 24 is deposited on the interior surfaces of ink channel 29 and on the upper surface of the wall portion 34 to form the common electrode 62, which is preferably maintained at ground potential. Metallization layer 22 is coated over approximately half the outer surface of wall portion 34 and over the lower outer surface of base portion 36 to define an addressable electrode 60, which is selectively connected to an electrical signal source to drive the print head transducer 2. Upon the application of a positive voltage signal to the addressable electrode 60, the orientation of the applied electric field established in the transducer material is substantially as shown in FIG. 6. At the center of the base portion 36 of the print head transducer 2, it can be seen that a substantial portion of the electric field generated between addressable electrode 60 and common electrode 62 is in the same direction as the poling direction 30 of piezoelectric material, thereby substantially actuating that portion of the transducer material in the normal mode. At the wall portion 34, a substantial portion of the electric field generated between addressable electrode 60 and common electrode 62 is perpendicular to the poling direction 30, thereby substantially actuating that portion of the transducer in the shear mode toward the other lateral wall 32 (see FIG. 7). In the preferred embodiment, the electric field established between addressable electrode 60 and common electrode 62 changes in orientation, from the base portion 36 to the wall portion 34, substantially as shown in FIG. 6.

Figure 7:
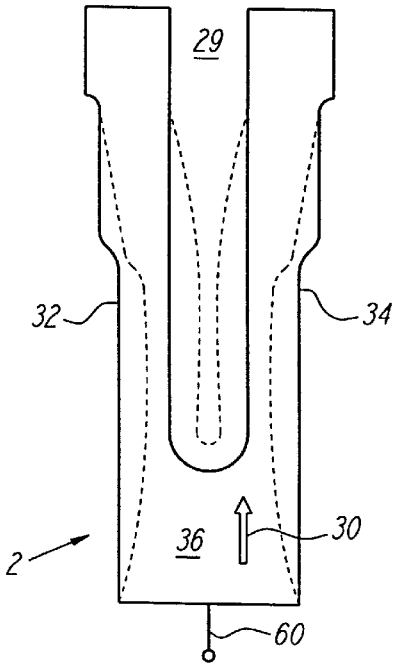
FIGS. 7 and 8 illustrate the mechanical movement of the transducer in the preferred print head structure constructed in accordance with the present invention.

FIG. 7 illustrates the movement of the transducer material in the preferred embodiment upon application of a positive voltage to the addressable electrode 60. The dashed lines in FIG. 7 indicate the directional extent of movement by the print head transducer 2 upon the application of a positive voltage. Since the material of base portion 36 is substantially actuated in the normal mode, that portion of the transducer actuated in the normal mode, that portion of the transducer material becomes elongated in a direction substantially parallel to the poling direction 30 of the piezoelectric material, inwardly into the ink channel 29. Since portions of the piezoelectric material of the wall portion 32 and 34 substantially deflect in the shear mode, the wall portion bend inward, substantially perpendicular to the poling direction 30 of the piezoelectric material. Therefore, the application of positive voltage to electrode 60 results in the movement of the base portion 36 and wall portions 32 and 34 of the print head transducer 2 inward, toward the ink channel 29, resulting in a diminishment of the interior volume of the ink channel 29. The extent of transducer movement illustrated in FIG. 7 has been exaggerated for clarity of explanation, and the particular range of movement actually produced by an embodiment of the present invention depends upon the particular parameters of the print head transducer and/or electrical drive signal employed.

Figure 8:
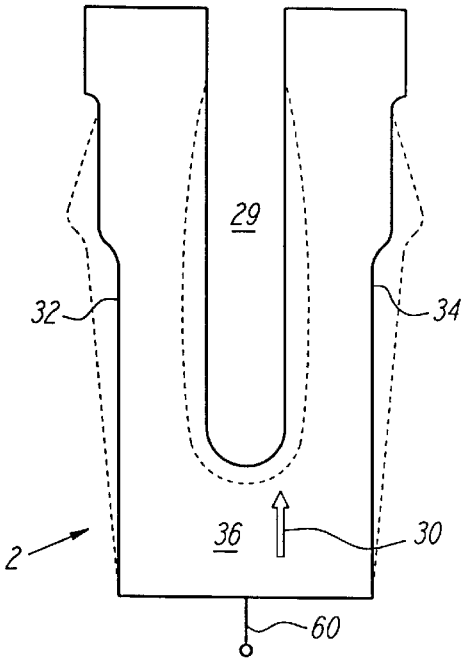

FIG. 8 illustrates the movement of transducer material in the preferred embodiment upon application of negative voltage to the addressable electrode 60. The dashed lines in FIG. 8 indicate the directional extent of movement by the transducer material upon the application of voltage to the electrode 60. For the application of negative voltage, since the material of base portion 36 is substantially actuated in the normal mode, that portion of the transducer material becomes shorter and wider. Portions of the piezoelectric material of wall portion 32 and 34 are actuated in the shear mode, and thus, the wall portions bend outward, away from the ink channel 29. Therefore, the application of negative voltage results in a net volume increase in the interior area of the ink channel 29. Like the depiction in FIG. 7, the extent of transducer movement illustrated in FIG. 8 has been exaggerated for clarity of explanation, and the particular range of movement actually produced by an embodiment of the present invention depends upon the particular parameters of the print head transducer and/or electrical drive signal employed.

In operation, the application of an electrical drive signal to the addressable electrode 60 of the print head transducer 2 causes a mechanical movement or distortion of the walls of the ink channel 29, resulting in a volume change within the ink channel 29. This change in volume within the ink channel 29 generates an acoustic pressure wave within ink channel 29, and this pressure wave within the ink channel 29 provides energy to expel ink from orifice 38 of print head structure 20 onto a print medium.

Of particular importance to the operation of the print head structure 20, and to the creation of acoustic pressure waves within the ink channel 29, are the particular parameters of the electrical drive signal which is applied to the transducer material of the print head structure 20. Manipulating the parameters of an applied electrical drive signal (e.g., the amplitude, frequency, and/or shape of the applied electrical waveform) may significantly affect the mechanical movement of the print head transducer structure, which affects the characteristics of the acoustic pressure wave(s) acting within the ink channel 29, which in turn affects the size, volume, shape, speed, and/or quality of the ink drop expelled from the print head 20. Details of the preferred method to operate print head structure 20 are disclosed in copending application serial no. (N/A), entitled "Inkjet Print Head for Producing Variable Volume Droplets of Ink", Lyon & Lyon Docket No. 220/105, which is being filed concurrently with the present application, and the details of which are hereby incorporated by reference as if fully set forth herein. As disclosed in that copending application, the print head structure 20 is preferably operated with variable amplitude multi-pulse sinusoidal input waveforms at the resonant frequency of the ink channel 29, which allows the expulsion of variable volume ink drops from the print head structure 20 at substantially constant drop speeds.

Figure 11:
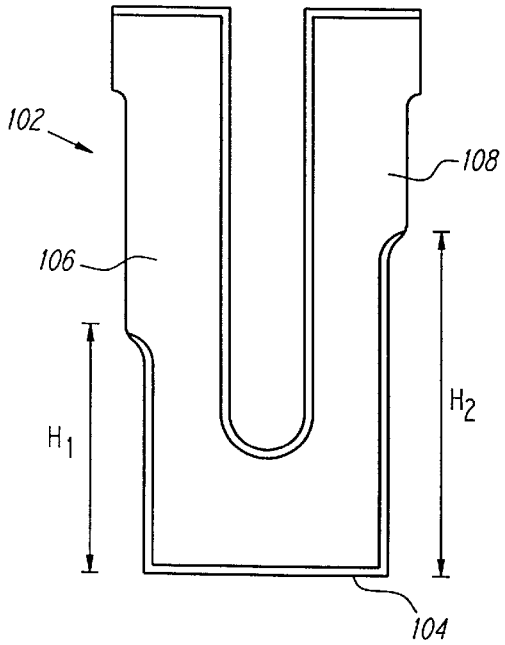
FIG. 11 shows the front view of an alternate print head transducer structure according to the present invention, wherein the addressable electrode metallization layer is not symmetrically coated on the first and second wall portions.
Figure 12:
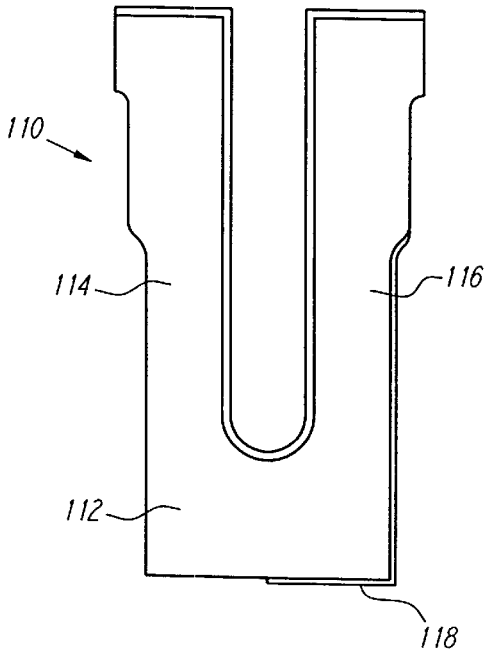
FIG. 12 depicts the front view of a print head transducer according to an alternate embodiment of the present invention.

Referring to FIG. 11, an alternative embodiment of the present invention is shown comprising a print head transducer 102 wherein the metallization layer forming the addressable electrode 104 is not symmetrically coated over the exterior surfaces of the first and second side wall portions 106 and 108. As shown in FIG. 11, the addressable electrode metallization layer 104 coated on the first side wall portion 106 extends to a height H1, while the coating at the second side wall portion 108 extends to a height H2, where H1 and H2 are not equal. Thus, application of voltage to the addressable electrode 104 in this embodiment will tend to produce non-symmetrical movements of the side wall portions 106 and 108. Another embodiment of the present invention is depicted in FIG. 12, wherein a print head transducer 110 has an addressable electrode metallization layer 118 which coats only one-half of the exterior surface of the base portion 112 along with the exterior surface of only a single wall portion 116. In this embodiment, the application of voltage to the addressable electrode 118 will significantly actuate only half the print head transducer structure 110.

Figure 3A:
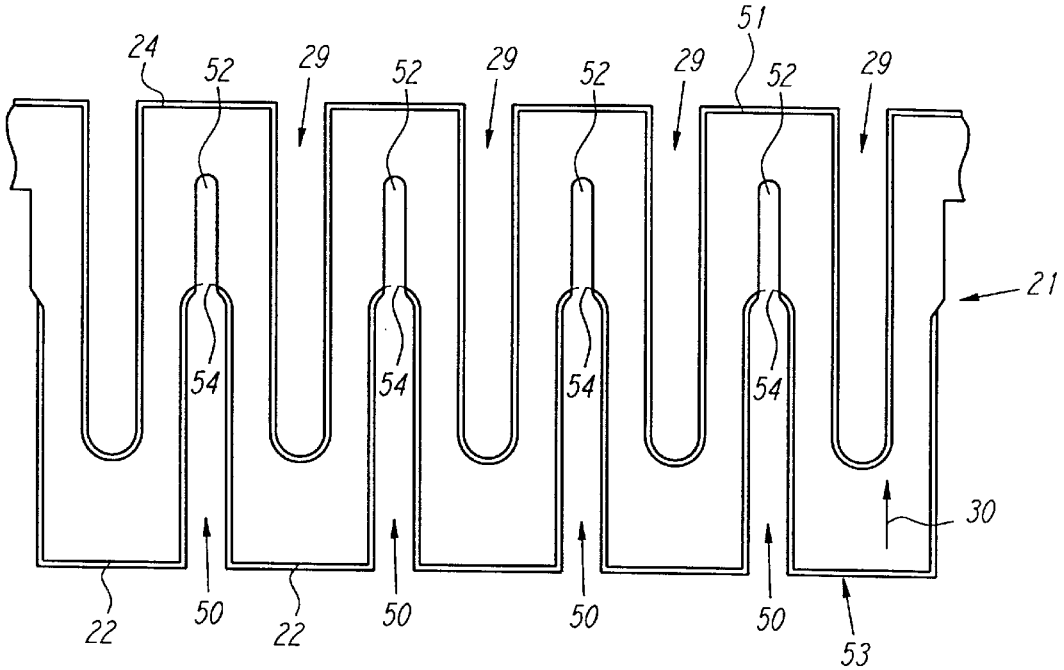
FIG. 3A is a front view of a portion of the structure of a sheet of transducer material for an array of ink channels according to the embodiment of the present invention shown in FIG. 2.
Figure 3B:
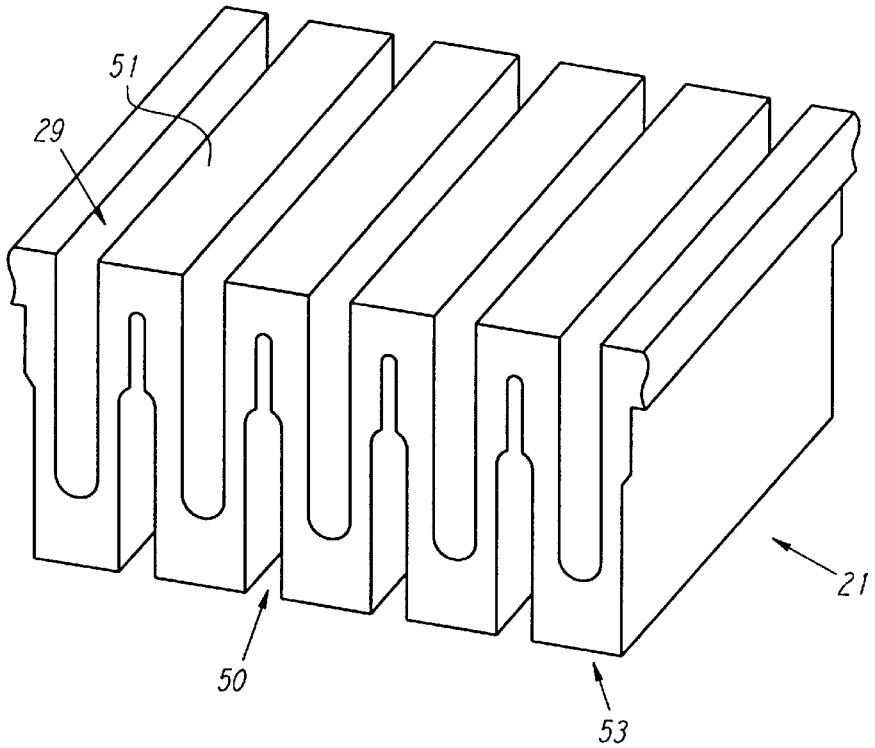
FIG. 3B is a perspective view of the sheet of transducer material shown in FIG. 3A.

With reference to FIGS. 3A and 3B, a multiple-channel inkjet print head constructed in accordance with the present invention comprises an array of print head structures 20, each having an ink channel 29 in the array linearly adjacent and substantially parallel to its neighboring ink channel 29. A single block, sheet, or wafer of piezoelectric material 21 is preferably used to manufacture the transducer portion of the array of ink channels. FIGS. 3A and 3B show a portion of piezoelectric sheet 21 into which a series of substantially identical and generally parallel ink channels 29 have been cut into a first face 51 of sheet 21. Directly opposite from the first face 51 of sheet 21, a series of substantially identical and generally parallel air channels 50 are cut into a second face 53, with each air channel 50 interspaced between an adjacent ink channel 29. During the manufacturing process, the air channels 50 are initially cut to a depth approximately halfway along the cut depth of each ink channel 29, to approximately the relative distance marked by dashed lines 54 of FIG. 3A. A metallization layer 24, defining common electrode 62, is deposited onto the inner surfaces and interior end of each ink channel 29, and over the first face 51 of sheet 21. Metallization layer 24 is connected continuously from ink channel to ink channel, and is preferably maintained at ground potential. Another metallization layer 22, defining the addressable electrodes 60, is deposited onto the inner surfaces and interior end of each air channel 50 (up to and including the surface marked by dashed lines 54) and over the second face 53 of sheet 21, with the metallization layer 22 initially connected from air channel to air channel at the bottom 54 of each air channel 50. An electrode-separation channel 52 is then cut into each air channels 50, which also breaks the connection between the individual metallization layers 22 within each air channel 50. Thus, the metallization layer 22 for each addressable electrode 60 is a discrete element, and the addressable electrodes 60 can then be separately and selectively connected to an electrical drive signal source. The electrode-separation channel 52 significantly extends the cut gap created by the combined cut depths of the air channel 50 and the electrode-separation channel 52 towards the first face 51 of piezoelectric sheet 21. In the preferred embodiment, this method of manufacture results in the metallization layer 22 forming addressable electrode 60 extending down each air channel 50 to a position corresponding to approximately half the total cut depth of the adjacent ink channel 29. If the metallization layer 22 extends to a position which is too far towards the first face 51 of sheet 21, then the actuation of the transducer material in the shear mode may cause the wall portions 32 and 34 to bend both towards and away from the interior of ink channel 29 at the same time, resulting in less than optimal volume displacement of the ink channel 29. If the metallization layer 22 does not extend far enough towards the first face 51, then the actuation of the transducer material will not produce the desired maximal movement of the wall portions 32 and 34, again resulting in less than optimal volume displacement of the ink channels 29. However, the above-disclosed metallization depth for the addressable electrodes may differ depending upon the specific application or print head configuration in which the present invention is utilized. For manufacturing purposes, the electrode-separation channel 52, the air channels 50, and the ink channels 29 are all preferably cut with interior end-surfaces having a rounded bottom.

The lower cross-section of the base portion 36 of print head transducer 2 preferably has a rectangular shape when viewed from the front. The combination of the physical geometry of a rectangularly shaped cross-section for the base portion 36, along with the particular shape and orientation of the generated electric field resulting from a rectangularly shaped base portion 36, provides for an efficient combination of shear and normal mode actuation of the print hear transducer 2. Further, a rectangular cross-sectional shape results in the lower surface of base portion 36 having a relatively wide lower surface area on which to deposit a metallization layer 22 to form the addressable electrode 60. The relatively wide surface area on the lower surface of the base portion 36 provides for a greater portion of the electric field created between the addressable and common electrodes at the base portion 36 to have an orientation which actuates the base portion 36 in the normal mode, i.e., electric field orientation which is substantially parallel to the poling direction 30. Employing a base portion rectangular shape having rounded corners, rather than the sharp angular corners shown in FIG. 2, would not significantly affect the actuation of the print head transducer 2, and is expressly within the scope of the present invention. Alternatively, the lower cross-section of base portion 36 can be formed in the shape of an inverted trapezoid, wherein the outer walls of the base portion 36 slant inward, toward each other, thereby narrowing the width of the lower surface of the base portion 36. This embodiment is less preferred than the above-described rectangular shape, since less surface areas is available along the lower surface of base portion 36 for the addressable electrode metallization layer, and the physical geometry is less efficient for actuation of the print head. A base portion having a lower cross-section in the shape of an inverted triangle is much less preferred than a rectangular shape, since the geometry is less efficient for actuating the print head, and since less lower surface area is available for deposition of an addressable electrode metallization layer, thereby decreasing efficient normal mode actuation of the base portion 36.

Figure 9:
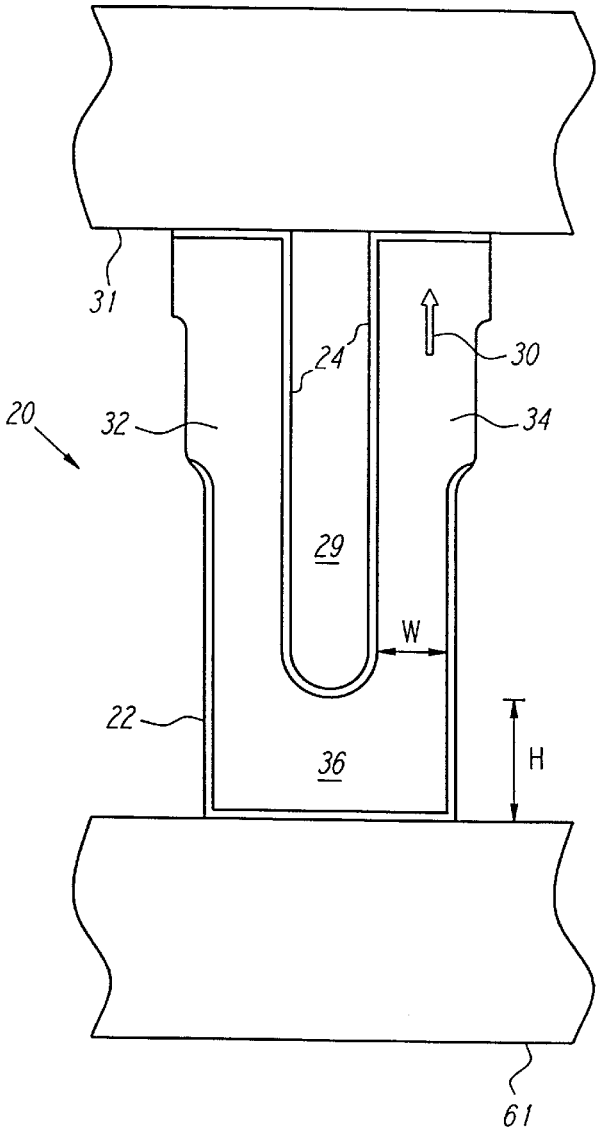
FIG. 9 depicts an alternate print head structure constructed in accordance with the present invention.

With reference to FIG. 9, the height H of the base portion 36 is preferably equal to the width W of the wall portions 32 and 34. However, the present invention can be practiced with other height dimensions for base portion 36, and alternatively preferred embodiments comprise a base height range of approximately 0.5 to 5 times the width W of wall portions 32 and 34.

An alternate embodiment of the present invention further comprises a base cover plate 61 which is bonded or glued to the lower outer surface of the base portion 36 (FIG. 9). The base cover plate 61 enhances the movement of the normal mode deflection of the base portion 36 when the print head transducer 2 is actuated. When the base portion 36 is actuated in the normal mode with a positive polarity electrical signal, the material of the base portion has a tendency to deform in an elongated manner parallel to the poling direction 30, with the upper surface of the base portion 36 elongating upward toward the ink channel 29, and the lower surface of the base portion 36 elongating downward, away from the ink channel 29. The base cover plate 61 provides a restraining force on the outer layer surface of base 36, resisting the movement of the lower surface of the base portion 36. The physical result of the restraining force applied by the base cover plate 61 is for the upper surface of base portion 36 to further elongate upward, increasing the volume displacement within ink channel 29 by enhancing the distance that the base portion 36 elongates into the ink channel 29. Likewise, when the base 36 is actuated with a negative polarity electrical drive signal, the base cover plate 61 restrains the tendency of the lower surface of the base portion 36 to deform in a compressive manner. The base portion 36 physically compensates for this restraining force by increasing the movement of the upper surface of the base portion 36 downward, away from the ink channel 29, thereby enhancing the volume change within the ink channel 29 from the normal mode deflection of the base portion 36.

In the preferred embodiment, metallization layers 22 and 24 are formed of gold, and are sputter-deposited onto the piezoelectric sheet 21. The cuts made in the piezoelectric sheet 21 are preferably made with diamond saws, utilizing techniques and apparatuses familiar to those skilled in the semiconductor integrated circuit manufacturing arts. The ink channel cover 31 is preferably glued or bonded to the metallization layer 24 on the upper surface of sheet 21 to close off the ink channels 29. The nozzle plate 33 and rear cover plate 48 are preferably glued or bonded to the front and rear surfaces of sheet 21, respectively. The ink channel cover 31, base cover plate 61, and nozzle plate 33 should preferable be formed of a material having a coefficient of thermal expansion compatible with each other. The nozzle is formed of gold-plated nickel in the preferred embodiment, although other materials such as PZT are within the scope of this invention. The ink channel cover 31 and base cover plate 61 are preferable formed of PZT, although other materials may also be appropriately used within the scope of this invention, including but not limited to silicon, glass, and various metallic materials.

An advantageous aspect of the present invention is that a multiple-channel print head can be formed from a single sheet of piezoelectric material that has been pre-polarized in an appropriate poling direction prior to manufacture of the print head structure 20. This ability to manufacture with a pre-polarized block of material is a significant advantage over the prior art piezoelectric print head structures, which may require the polarization of the piezoelectric material later in the manufacturing cycle. By using a pre-polarized sheet of piezoelectric material, more consistency is obtained with regard to the overall polarization of the piezoelectric material employed. For example, a pre-polarized sheet of piezoelectric material can be thoroughly tested for the appropriate piezoelectric properties prior to machining, rather than after the expense and efforts of machining have already been performed on a particular sheet of piezoelectric material.

Another advantageous aspect of the present invention is that the alternating air/ink channel design of the preferred print head serves to reduce mechanical crosstalk between adjacent ink channels normally resulting from the motion of the actuated piezoelectric transducer material. Thus, although the preferred embodiment allows a densely packed array of ink channels to be placed together, this structure also tends to reduce interference which may occur from one ink channel to the next. This favorable reduction in crosstalk in the preferred design is due to the comparatively small extent of mechanical coupling between the adjacent ink channels, and is also due to the insulating properties of the cut gap formed by the combined air channels 50 and electrode separation channels 52.

Figure 10:
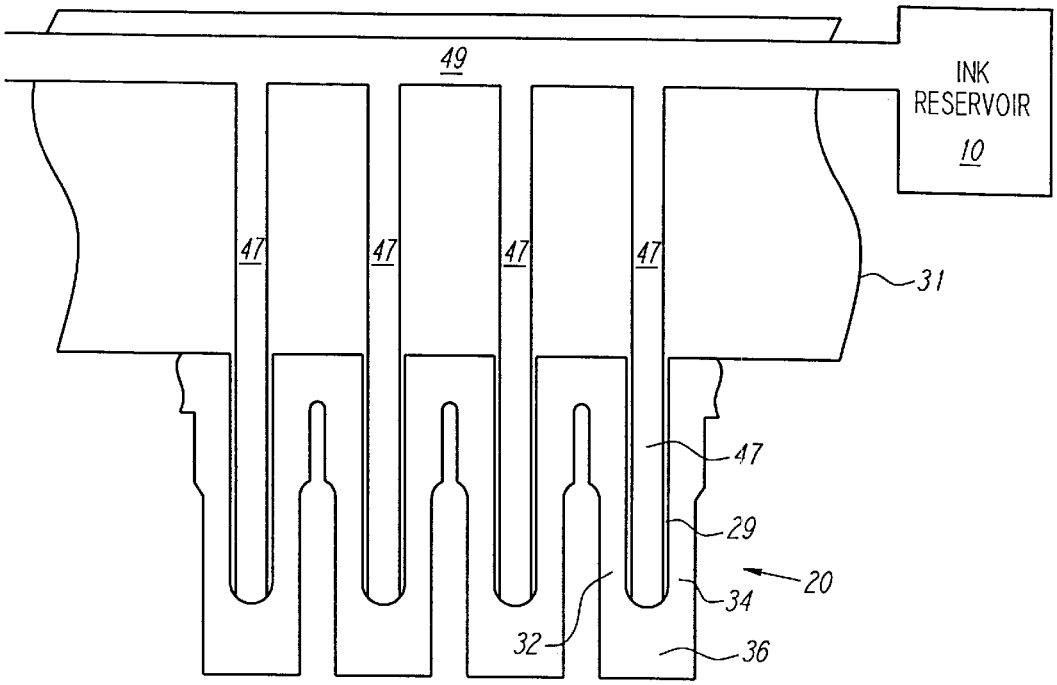
FIG. 10 depicts an ink feed structure for an embodiment of the present invention.

Supplying ink to the individual ink channels from a common ink reservoir 10 may create a crosstalk path, since pressure waves from one ink channel 29 may travel through the ink feed passageway 49 to an adjacent ink channel, and these unwanted pressure waves will, in turn, affect the efficient operation of the adjacent ink channel. Thus, to further reduce crosstalk, in an alternate embodiment of the present invention there is provided a protective ink feed structure to supply ink from the ink reservoir 10 to the ink channel 29. FIG. 10 is a view of the rear of print head structure 20, showing the path of a central ink feed passage 49, which may be formed as part of rear cover plate 48 (not shown in FIG. 10), that extends from the ink reservoir 10 the individual ink channels 29. One or more slotted passageways 47 extend from the central ink feed passage 49 to each ink channel 29. Each slotted passageway 47 is a grooved indentation formed in the rear cover plate 48, extending in length from the ink feed passageway 49 to the bottom of each ink channel 29. Each slotted passageway 47 in rear cover plate 48 has a tapering curve along its length substantially as shown in FIG. 1. Each slotted passageway 47 preferably has a slot width which is approximately the same width as the ink channels 29.

In operation, ink is constantly supplied to the central ink supply passage 49 from the ink reservoir 10, and when required by an individual ink channel 29, the ink is then drawn from the ink supply passage 49 through a slotted passageway 47 into the ink channel 29 by the pressure difference caused by the movement of the print head transducer 2, along with the pressure difference caused by the surface tension forces of the meniscus at the ink channel orifice. The use of slots or slotted passageway to supply ink to an ink channel, such as slotted passageway 47, helps to reduce the amplitude of pressure waves which escape the ink channels 29, reducing the probably that the escaping pressure waves will affect the operation of neighboring ink channels. This is in due in part to the length of the slotted passageways 49, which increases the distance that a pressure wave must travel to affect a neighboring ink channel 29, thereby diminishing the strength of the escaping pressure waves. In addition, the slotted passageways 49 are small enough in width to substantially prevent high frequency pressure waves from intruding into other ink channels.

Set forth in Table I are acceptable parameters for the block 21 of piezoelectric material forming the transducer for the preferred embodiment:

TABLE I

| Structure | | Dimension |
|---|---|---|
| A. | Thickness of PZT sheet | 0.0240 in. |
| B. | Cut width of ink channel | 0.0030 in. |
| C. | Cut depth of ink channel | 0.0193 in. |
| D. | Length of ink channel | 0.2000 in. |
| E. | Cut width of air channel | 0.0030 in. |
| F. | Cut depth of air channel | 0.0118 in. |
| G. | Cut width of electrode-separation channel | 0.0020 in. |
| H. | Cut depth of combined air channel and electrode separation channel | 0.0213 in. |
| I. | Distance from ink channel center to adjacent ink channel center | 0.0100 in. |
| J. | Distance from ink channel center to adjacent air channel center | 0.0050 in. |
| K. | Diameter of orifice in nozzle plate | 0.0014 in. |

The particular dimensions set forth above are the respective parameters of the preferred embodiment, and are not intended to be limiting in any way, since alternate print head structures within the scope of the present invention may have structural dimensions which differ from those set forth in Table I, depending upon the particular application in which this invention is used. In addition, those of skill in the art will realize that the voltage polarities or piezoelectric material poling directions employed and described above for the preferred embodiments could be reversed without affecting the scope or breadth of the disclosed invention. Further, the range and/or type of mechanical movement or distortion described and/or shown in connection with FIGS. 6–9 are for the purposes of illustration only, to pictorially facilitate the explanation of the invention, and are not intended to be limiting in any way, since different shapes, dimensions or parameters of the transducer material could be employed within the scope of the present invention to create or actuate other types of transducer movement or distortion. In addition, positional orientation terms such "lateral", "top", and "rear" are used to describe certain relative structural aspects of the preferred embodiment; however, these relative positional terms are used only to facilitate the explanation of the invention, and are not intended to limit in any way the scope of the invention.

While embodiments, applications and advantages of the invention have been shown and described with sufficient clarity to enable one skilled in the art to make and use the invention, it would be equally apparent to those skilled in the art that many more embodiments, applications and advantages are possible without deviating from the inventive concepts disclosed, described, and claimed herein. The invention, therefore, should only be restricted in accordance with the spirit of the claims appended hereto or their equivalents, and is not to be restricted by specification, drawings, or the description of the preferred embodiments.

What is claimed is:

1. A method of manufacturing a print head comprising the steps of:

(a) cutting a plurality of substantially parallel ink channels into a first face of a piezoelectric sheet;

(b) cutting a plurality of substantially parallel air channels into a second opposite face of said piezoelectric sheet, said air channels being interspaced between and generally parallel to said ink channels;

(c) depositing a first electrode metallization layer to said first face and in said plurality of ink channels;

(d) depositing a second electrode metallization layer to said second opposite face and in said plurality of air channels;

(e) cutting an electrode-separation channel extending through and beyond said second electrode metallization layer at the bottom of each of said plurality of air channels.

2. The method of claim 1 further comprising the step of grounding said first electrode metallization layer.

3. The method of claim 1 wherein the cut depth of said plurality of air channels of step (b) extend toward said first face to a position corresponding to approximately half the depth of each of said plurality of ink channels.

4. The method of claim 1 further comprising the step of attaching a base cover to said second face.

5. The method of claim 1 wherein said plurality of ink channels of step (a) are cut with a rounded bottom.

6. The method of claim 1 wherein said electrode-separation channel of step (e) or said plurality air channels of step (b) are cut with a rounded bottom.

* * * * *